US010099110B2

(12) United States Patent
Schmidt

(10) Patent No.: US 10,099,110 B2
(45) Date of Patent: Oct. 16, 2018

(54) SKATEBOARD, EXTENSION FOR A SKATEBOARD, AND SYSTEM THEREOF

(71) Applicant: HYVE AG, Munich (DE)

(72) Inventor: Michael Schmidt, Wessling (DE)

(73) Assignee: HYVE AG, Munich (DE)

( * ) Notice: Subject to any disclaimer, the term of this patent is extended or adjusted under 35 U.S.C. 154(b) by 0 days.

(21) Appl. No.: 15/387,927

(22) Filed: Dec. 22, 2016

(65) Prior Publication Data

US 2017/0173445 A1 Jun. 22, 2017

(30) Foreign Application Priority Data

Dec. 22, 2015 (DE) ..... 10 2015 226 593

(51) Int. Cl.
*A63C 17/01* (2006.01)
*A63C 17/00* (2006.01)

(52) U.S. Cl.
CPC ..... *A63C 17/0086* (2013.01); *A63C 17/01* (2013.01); *A63C 2203/42* (2013.01)

(58) Field of Classification Search
CPC ..... A63C 17/015; A63C 17/006; A63C 17/01; A63C 17/12; A63C 17/0086
See application file for complete search history.

(56) References Cited

U.S. PATENT DOCUMENTS 4,161,326 A * 7/1979 Gaber ..... A63C 17/01 280/11.208
4,723,789 A * 2/1988 Schmidt ..... A63C 5/02 156/268
D505,470 S * 5/2005 Hong ..... A63C 17/12 D21/765
7,121,909 B1 * 10/2006 Meyerhoffer ..... B63B 35/7916 114/352
7,390,234 B2 * 6/2008 Peach ..... A45F 3/04 114/352
7,635,137 B2 12/2009 Gregory et al.
7,976,034 B1 * 7/2011 Hong ..... A63C 17/01 280/87.042
8,827,286 B2 * 9/2014 Woncik ..... A63C 17/0006 280/87.042
8,910,959 B2 * 12/2014 Alva ..... A63C 17/015 280/87.05
9,010,776 B2 * 4/2015 Elliott ..... B62K 19/14 280/87.021

(Continued)

FOREIGN PATENT DOCUMENTS

DE 10056891 C2 7/2003
DE 102006043558 B4 9/2014
WO 2015013182 A1 1/2015

OTHER PUBLICATIONS

Office Action dated Aug. 25, 2016 by the German Patent & Trademark Office in related application DE 10 2015 226 593.5, partial machine translation provided.

*Primary Examiner* — Hau V Phan
(74) *Attorney, Agent, or Firm* — Hassan Abbas Shakir; Katten Muchin Rosenman LLP

(57) ABSTRACT

A skateboard has one or two standing surface extensions. The extension or extensions are mounted on the skateboard and dismounted therefrom by means of a tongue-groove principle to equip a skateboard having a pintail with a kicktail at the front and at the rear or optionally only at the front/rear or at the front and the rear.

18 Claims, 7 Drawing Sheets

(56) References Cited

U.S. PATENT DOCUMENTS

| | | | | |
|---|---|---|---|---|
| 2007/0029749 | A1* | 2/2007 | Gregory | A63C 17/0086<br>280/87.042 |
| 2007/0029750 | A1* | 2/2007 | Gregory | A63C 17/0086<br>280/87.042 |

* cited by examiner

Fig. 6 SECTION A - A

SKATEBOARD, EXTENSION FOR A SKATEBOARD, AND SYSTEM THEREOF

BACKGROUND OF THE INVENTION

1. Field of the Invention

The invention relates to a skateboard, such as a longboard; a standing surface extension therefor, such as a tailkick; as well as a system of a skateboard and a standing surface extension.

2. Discussion of the Related Art

From the prior art, longboards having a pintail, i.e., a pointed end which has only a slight overhang over the axle, as well as longboards with a tailkick, i.e., a wide end which has a larger overhang over the axle, are known.

The advantage of a longboard having a pintail is that it is relatively unaffected by wheelbites. A wheelbite is a condition in which, during cornering, the board edge of a longboard comes into contact with one of the wheels on the inner side of the curve and gets stuck. This is due to the fact that the axles of a longboard automatically steer to the left and right due to the axle geometry thereof when the board tilts. If, for example, the board is tilted to the right, the front wheels steer to the right and the rear wheels in the opposite direction to the left. This initiates a turn in the direction of the board inclination. When steering to the right, the wheels on the right side of the board (front and rear) move towards each other. The distance of the wheels on the right side of the board to the wider, middle area of the longboard decreases. At the same time, the tilting of the board reduces the distance from the right edge of the board to the wheels on the inner side of the curve. In the case of the wheelbite mentioned above, at least one of the wheels on the inner side of the curve touches the board and, in the worst case, gets stuck, which can lead to a loss of control of the rider. Due to the pointed ends of a longboard having a pintail, the distance between the edge of the board and the wheels is still large enough to minimize the risk of a wheelbite or to prevent it. However, due to the pointed ends, the rider is forced to be relatively centred on the board, whereby both axles are loaded during riding.

Furthermore, longboards having a tailkick are known. Because of the wider ends (front and/or rear), which protrude beyond the axle to the front or rear, the rider also has a standing surface on the board which is exactly above an axle, or even in front of the axle (at the front end of the board) or behind the axle (at the rear end of the board). This makes it possible for the rider, for example, in order to jump, to lift an axle of the board from the ground by shifting his body weight to in front of the front axle or behind the rear axle. As a result, the board is moved upwards like a rocker. With sufficient force, a complete lifting of the board from the ground is possible. A tailkick over the front axle is also very advantageous for drifting during a downhill ride, as the rider can thus shift the bulk of his body weight onto the front axle prior to the initiation of the drift, and can push the unloaded rear axle away from himself for the initiation of the drift.

Whether a rider is using a board having a pintail or a tailkick is also dependent on whether he wants to use the board primarily for city riding (tendency to pintail), or rather for downhill riding (tendency to tailkick). Furthermore, if a widely spread foot position is preferred, the choice is also more likely to be a longboard having a tailkick. In addition, some riders prefer a pintail on the one hand and a tailkick on the other hand for individual reasons. Freestyle tricks can only be executed with kicktail boards.

Furthermore, longboards from the prior art are configured as either pintail or tailkick in the front or the rear. Boards which have a tailkick on one side and a pintail on the other side are also known.

In particular, a longboard having a pintail and consisting of a carbon fibre structure, the HYVE® GridBoard, is known in the art.

It is an object of the invention to provide a skateboard, a standing surface extension, and a system of both, whereby a rider can individually and reversibly adapt a single skateboard or longboard to obtain either a version as a pintail or as a tailkick at the front and/or at the rear.

SUMMARY OF THE INVENTION

In the following, the term skateboard is used throughout. However, the special embodiment of the skateboard, the longboard, is also explicitly included herein.

By providing a fastening device at the front and/or rear end of the board or deck of a skateboard, or more precisely at the front and/or rear end of the deck of the skateboard, a standing surface extension can be mounted at a front and/or a rear pintail of a skateboard. This allows a pintail to be converted to a kicktail. By removing the standing surface extension, the kicktail can be reconverted to a pintail. This allows a rider to customize his skateboard individually. He can also ride his board temporarily with a pintail at the front and at the rear and carry two standing surface extensions in a backpack. If necessary, the pintail at the front and/or at the rear may be reversibly converted into a kicktail at any time.

An x-axis, which extends in the direction of travel of the skateboard, as well as a y-axis, which extends perpendicular thereto from right to left, and a z-axis, which extends perpendicular to the x-axis and y-axis from bottom to top, are defined (see also FIGS. 5 and 6, which will be described later).

By virtue of an advantageous configuration of the fastening device, that secures the standing surface enlargement in a form-fitting manner in the y direction and the z direction, a fixed attachment of the fastening device to the skateboard, which is free of clearance, is possible. In addition, the fastening device is thereby easily attachable to the skateboard by fitting it on in the x direction. Advantageously, the fastening device of the skateboard is tapered towards the ends of the skateboard for this purpose.

Advantageously, the fastening device includes at least one surface for supporting the weight forces of a person standing on a standing surface extension. The weight forces of the person can thereby be introduced into the skateboard by means of a form-fit, whereby the design becomes particularly robust.

Advantageously, the standing surface extension has all the features which are necessary according to the advantages of the skateboard described above, in order to achieve these advantages.

The system of skateboard and standing surface extension has a locking element to connect skateboard and standing surface extension(s) with each other reversibly and in a manner resistant to vibrations.

In an exemplary embodiment not shown, the system includes a locking device which is formed integrally with the skateboard.

This locking device is configured to secure the standing surface extension by means of a form-fitting connection.

In a further exemplary embodiment not shown, the system advantageously includes a locking device which is integrally formed with the standing surface extension. This locking device is also configured to secure the standing surface extension and the skateboard by means of a form-fitting connection.

Advantageously, in a further exemplary embodiment not shown, the system includes a locking device which is neither formed integrally with the standing surface extension nor formed integrally with the skateboard. Rather, the locking device is provided as a separate part in this exemplary embodiment. This locking device is also configured to secure the standing surface extension and the skateboard by means of a form-fitting connection. This is achieved by penetrating standing surface extension and skateboard.

Advantageously, the locking device is configured such that, in an embodiment as a separate part, the locking device penetrates the skateboard as well as the standing surface extension in a direction which is not parallel to the x-axis. In an embodiment of the locking device as a non-separate part, the locking device advantageously penetrates the component to which it does not belong, again in a direction which is not parallel to the x-axis. Thereby, securing the standing surface extension(s) to the skateboard in a form-fitting manner may be achieved.

Advantageously, the locking device is configured such that the locking device is held in a locking position by means of clamping and/or by means of a form-fitting connection and/or by pretension at the locking position. This ensures that the lock is not released inadvertently during riding due to vibrations. Furthermore, the lock is readily and easily releasable if the user wants to remove a standing surface extension from the skateboard.

BRIEF DESCRIPTION OF THE INVENTION

DETAILED DESCRIPTION OF THE INVENTION

In the following, the term skateboard is used throughout. However, the special embodiment of the skateboard, the longboard, is also explicitly included herein.

Figure 1:
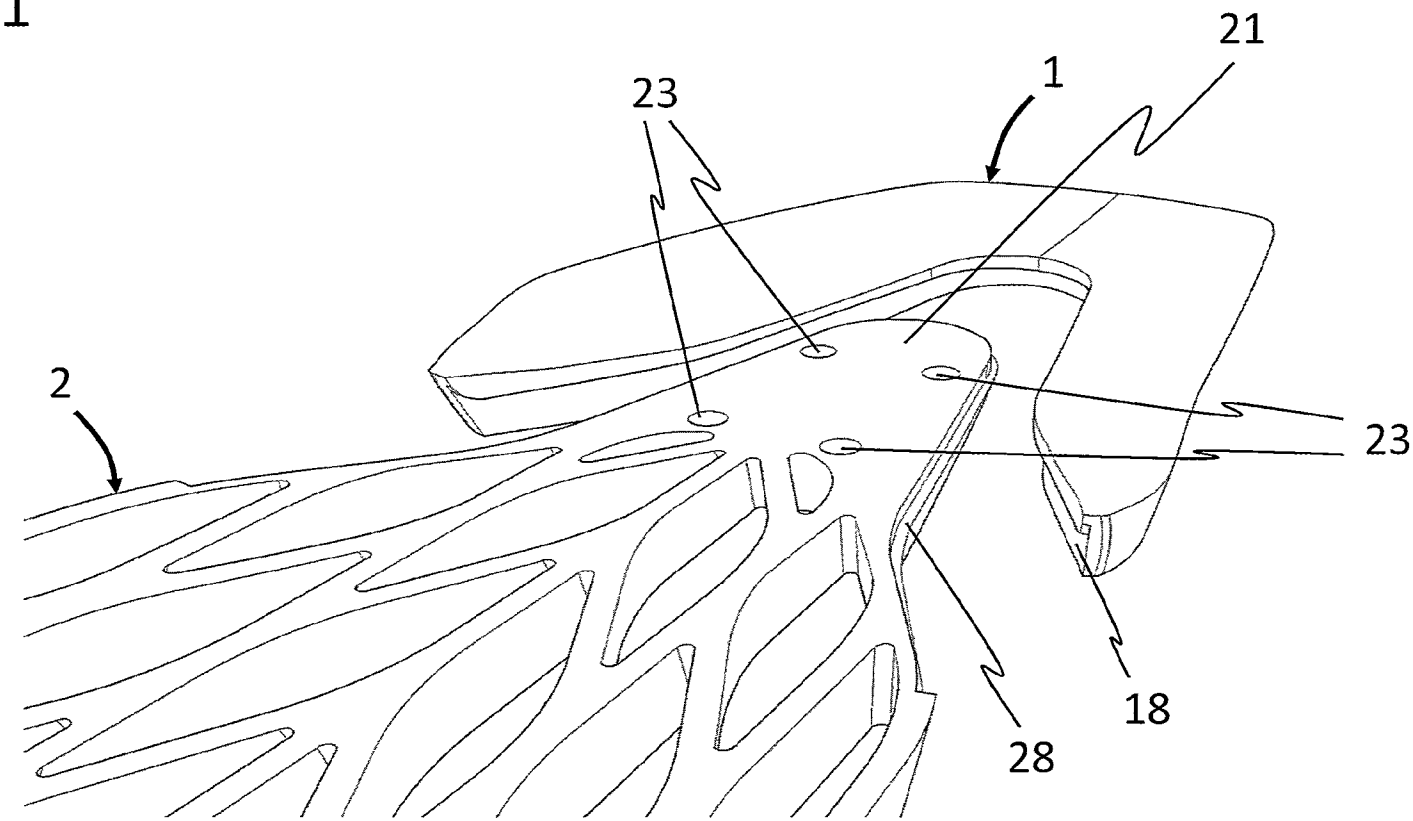
FIG. 1 shows a skateboard 2 with a non-mounted, but nevertheless illustrated standing surface extension 1 in an isometric view seen obliquely from above.

FIG. 1, as well as the figures described below, shows a modified embodiment of the HYVE® GridBoard. A front part of a skateboard 2 including a fastening device 28 which is tongue-shaped in plan view is shown. The skateboard has openings 23 which are provided for screwing the skateboard 2 and its axles (trucks), which are not shown, together. The axles of the skateboard 2 are not shown in any of the illustrations. The fastening device 28 of the skateboard 2 is provided for fastening a standing surface extension 1 by means of a receiving device 18. The receiving device 18 and the fastening device 28 are provided for a form-fitting engagement. The fastening geometry of the receiving device 18 and the fastening device 28 is shown in more detail in FIG. 6.

Figure 2:
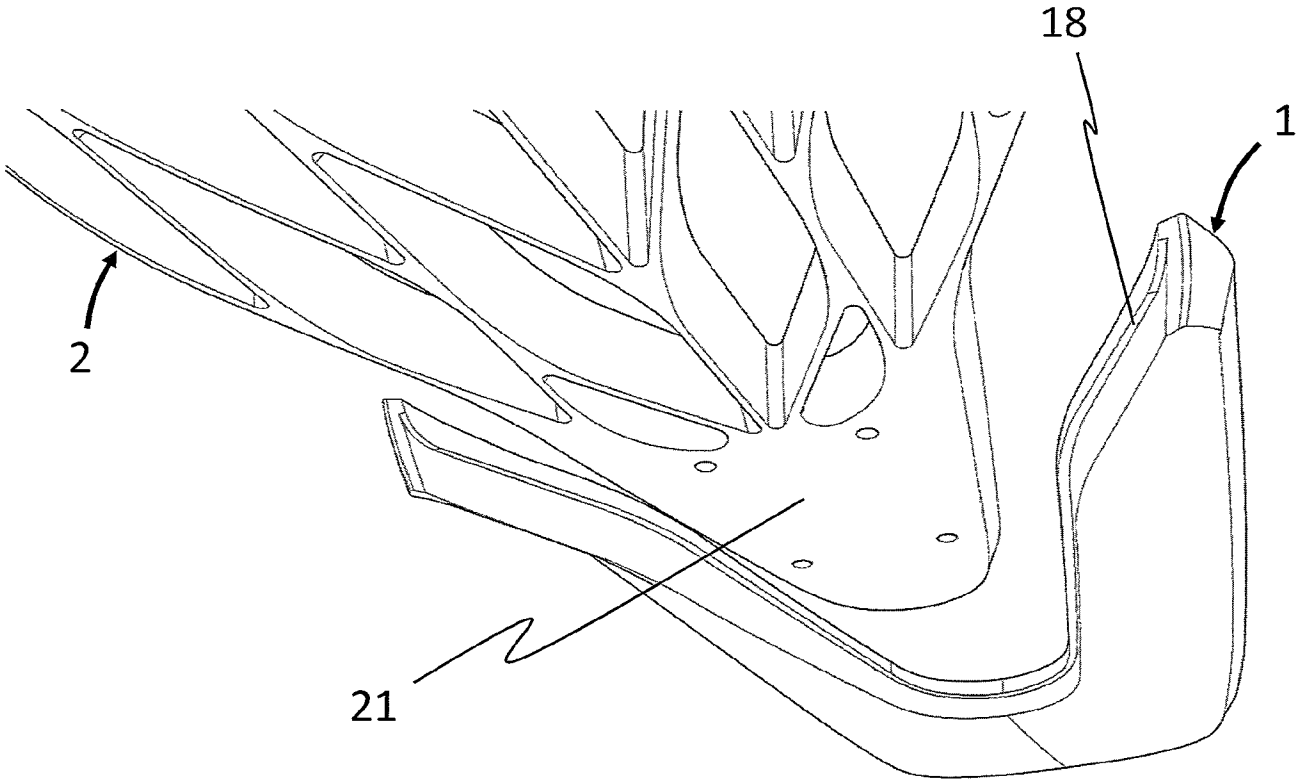
FIG. 2 shows the illustration of FIG. 1 seen obliquely from below.

FIG. 2 shows the isometric view of FIG. 1 seen obliquely from above. The illustrations shown in FIGS. 1 and 2 represent the front end 21 of the skateboard. It is formed in the shape of a tongue that tapers with increasing distance from the center of the board.

Figure 3:
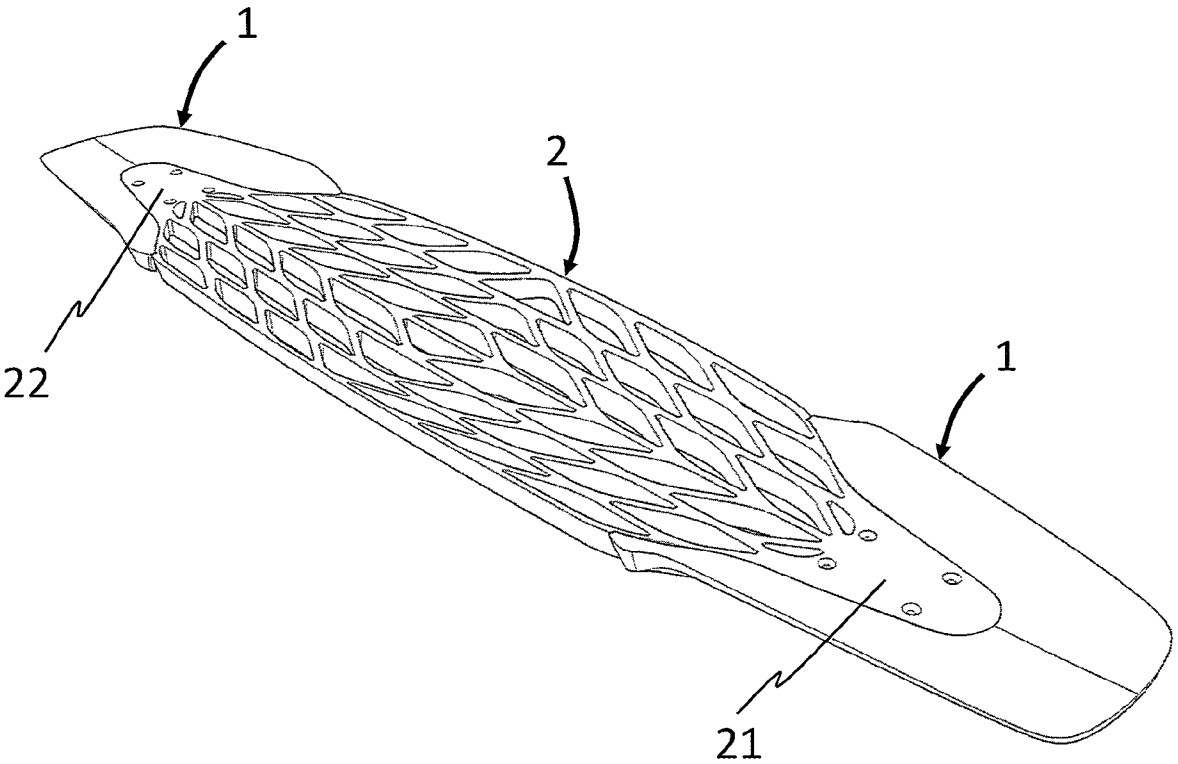
FIG. 3 shows an isometric view of a skateboard 2 with two mounted standing surface extensions 1.
Figure 4:
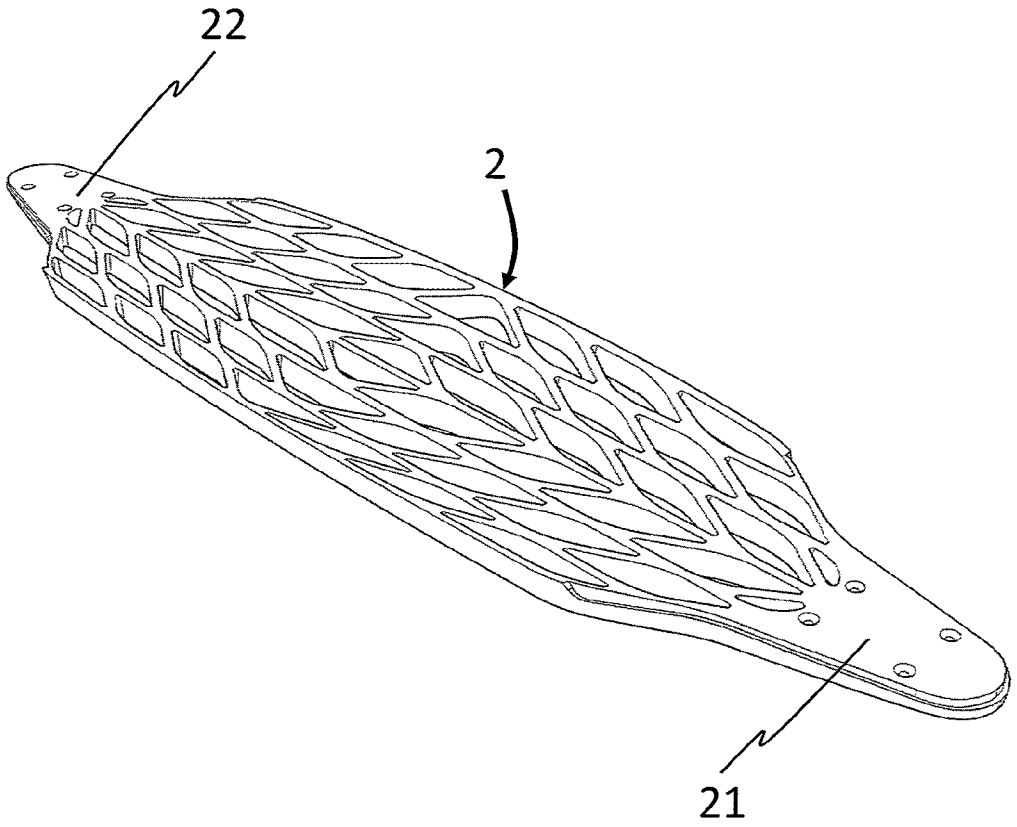
FIG. 4 shows an isometric view of a skateboard 2 without standing surface extensions 1.

FIG. 3 shows the skateboard 2 with two standing surface extensions 1 mounted thereon. At the rear end 22 and at the front end 21 of the skateboard 2, a standing surface extension 1 is attached. FIG. 4 shows the embodiment shown in FIG. 3, but with the standing surface extensions 1 removed.

Figure 5:
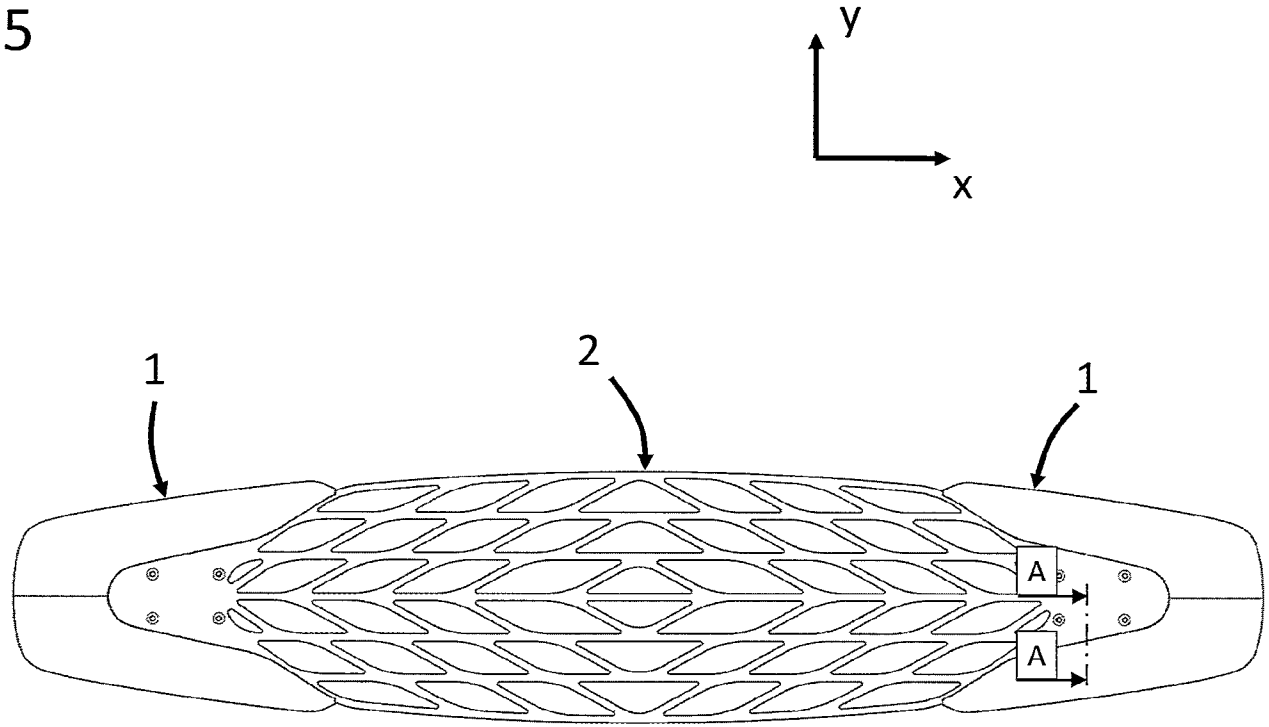
FIG. 5 show a plan view of a skateboard 2 with two mounted standing surface extensions 1.

FIG. 5 shows the skateboard 2 with two standing surface extensions 1 mounted thereon in plan view. Furthermore, a coordinate system is shown, which defines the direction of travel of the skateboard 2 as the x direction. Herein, the board of the skateboard 2 board defines a plane parallel to a plane, in which the x and y directions are. Thus, the y direction is transverse to the x direction, as shown in FIG. 5. Furthermore, FIG. 5 illustrates the position of a section A-A, which passes through the skateboard 2 and one of the standing surface extensions 1, in a region of the receiving device 18 and the fastening device 28.

Figure 6:
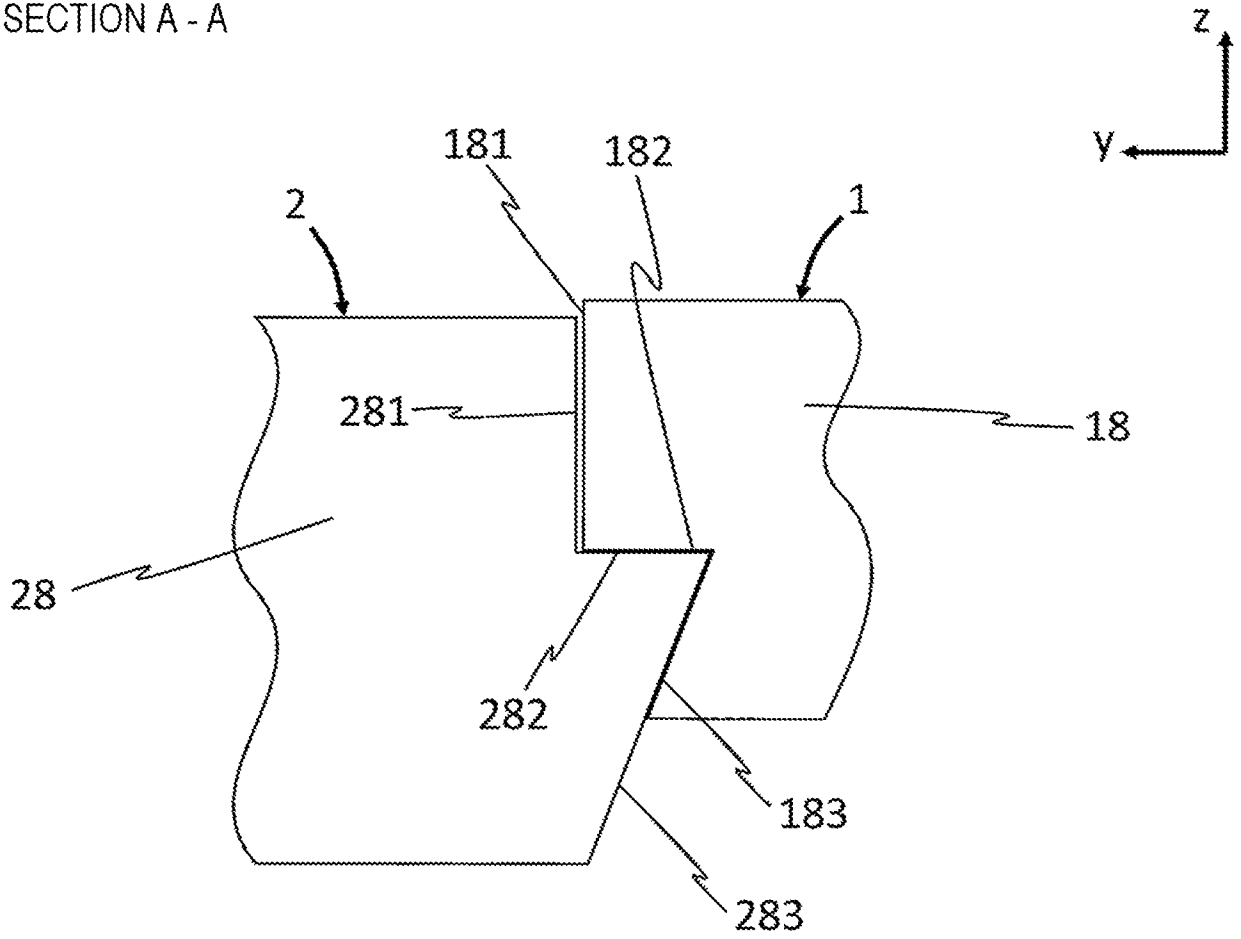
FIG. 6 shows the section A-A of FIG. 5.

FIG. 6 shows the embodiment illustrated in FIG. 5. The z axis points upwards in the vertical direction. Thus, the section A-A passes through a plane, which is parallel to a plane, in which the y and z direction are. Furthermore, the y axis is to define a horizontal axis. The section A-A shows the form-fitting engagement of the skateboard 2 and the standing surface extensions 1. In this exemplary embodiment, the skateboard 2 has a horizontal surface 282, and the standing surface extensions 1 have a horizontal surface 182. These two horizontal surfaces 182, 282 are provided for supporting the standing surface extension 1 on the skateboard 2. If the rider of the skateboard puts load on the standing surface extensions 1 while riding, i.e., puts the bulk of his weight thereon, the weight of the rider can be introduced from the standing surface extensions 1 into the skateboard 2 by means of the horizontal surfaces 182, 282. Hence, the horizontal surfaces 182, 282 prevent the standing surface extensions 1 from moving downward with respect to the skateboard 2. Furthermore, an inclined surface 283 is provided at the skateboard 2, and an inclined surface 183 is provided at the standing surface extension 1. The mutually abutting surfaces 183, 283 are provided to prevent the standing surface extensions 1 from moving upward with respect to the skateboard 2. In the illustration shown in FIG. 6, a movement of the standing surface extensions 1 to the right appears to be possible. However, it is to be noted that the section A-A extends only through a part of the standing surface extensions 1 and the skateboard 2, as shown in FIG. 5. If the section A-A were to extend over the entire width, the geometry shown in FIG. 6 would exist once more in mirrored form (to the left of the illustration currently shown in FIG. 6). Accordingly, the surfaces 183, 283 prevent a relative movement of standing surface extensions 1 and skateboard 2 to the left/right, i.e. in y direction. A vertical surface 281 of the skateboard 2 does not touch a vertical surface 181 of the standing surface extension 1 in this embodiment. By providing a small gap between the surfaces 181 and 281, a double fit is prevented. A relative movement of the standing surface extension 1 and the skateboard 2 in the direction of the image plane (x direction) is only possible in one direction due to the contour of the fastening device 28, which tapers outward in the x-direction, or the contour of the receiving device 18 of the standing surface extension 1, which engages form-fittingly with this contour. The relative movability of the standing surface extension 1 and the skate board 2 in this one direction (x direction) is used to mount the standing surface extensions 1 on the skateboard 2 and to remove them therefrom.

In order to bring the skateboard 2 with the standing surface extension mounted thereon into a ready-to-ride state, the movability between the standing surface extension 1 and the skateboard 2 must be suppressed. For this purpose, a locking element (not shown) is provided, which penetrates a standing surface extension 1 and the skateboard 2 and is thus locked by means of a form-fitting connection.

Advantageously, this locking element is provided either as part of the standing surface extension 1, or as part of the skateboard 2, or as a separately provided component.

In a further embodiment not shown, the locking element is configured as a snap fit element. This snap fit element is attached to the standing surface extension 1 and hooks into the skateboard 2 in the assembled and thus to be locked position. In a further embodiment not shown, the snap fit element is attached to the skateboard 2 and hooks into the standing surface extension 1 in the assembled and thus to be locked position. The snap fit element of the embodiments just described preferably includes a spring element which urges the hook into the locked position.

The idea of the invention is essentially based on providing a possibility of connection between the standing surface extension 1 and the skateboard 2 by means of the tongue-groove principle. For this, the exact geometry of the flanks of the fastening device 28 or the receiving device 18 can vary without deviating from the scope of the invention.

Figure 7:
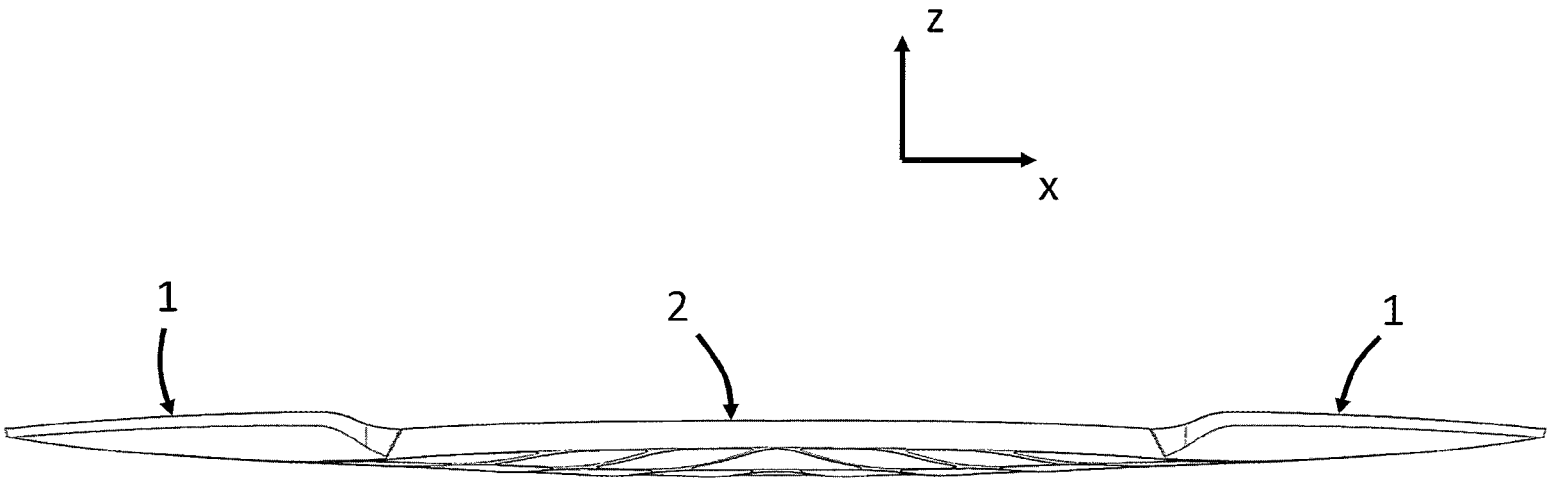
FIG. 7 shows the skateboard 2 of FIG. 5 in side view.

FIG. 7 shows a skateboard 2 with standing surface extensions 1 mounted thereon in side view. In this illustration, the axles with wheels are also not shown. The standing surface extensions 2 on the right-hand side of the illustration are curved upwards (in z direction) in the direction of the x axis. As a result, the distance between the lower edge of the standing surface extension 1 to the bottom not illustrated increases, whereby a larger deflection angle and thus a larger jump height is possible when executing various skateboard tricks (such as ollie).

The invention claimed is:

1. A skateboard comprising:

a deck defining in part a standing surface of the skateboard for a user and having a front end and a rear end, the deck defining an x-direction and a y-direction, a z-direction being substantially perpendicular to the x-direction and the y-direction;

a first axle disposed proximal to the front end;

a second axle disposed proximal to the rear end;

a standing surface extension for interchangeably extending the standing surface at the front end or the rear end;

wherein the deck comprises a first fastening device at the front end and a substantially identical second fastening device at the rear end, each fastening device for attaching the standing surface extension to the front end or the rear end;

wherein each fastening device comprises a first upright wall surface in the z-direction, a support surface extending in the x-direction and the y-direction for supporting a weight force of the user standing on the standing surface extension, and a first inclined surface extending from an edge of the support surface;

wherein the standing surface extension comprises a second upright wall surface in the z-direction, an engaging surface extending in the x-direction and the y-direction for transferring a weight force of the user standing on the standing surface extension to the support surface, and a second inclined surface abutting the first inclined surface, the second inclined surface preventing the standing surface extension from moving upward in the z-direction relative to the deck.

2. The skateboard of claim 1, wherein the first upright wall and the second upright wall are gapped.

3. The skateboard of claim 1, wherein the support surface comprises a first distance in the y-direction from the first upright wall to the edge of the support surface;

wherein the engaging surface comprises a second distance in the y-direction from an edge of the engaging surface to an intersection with the second inclined surface;

wherein the first distance is greater than the second distance.

4. The skateboard of claim 1, wherein the front end and the rear end substantially mirror image shapes.

5. The skateboard of claim 1, wherein the standing surface extension is movable in the x-direction relative to the deck.

6. The skateboard of claim 1, wherein the second inclined surface is inclined relative to the z-direction and the y-direction.

7. A standing surface extension for extending a standing surface of a skateboard, the standing surface defining an x-direction and a y-direction, a z-direction being substantially perpendicular to the x-direction and the y-direction, the standing surface extension comprising:

a receiving device for attaching the standing surface extension to a fastening device of the the skateboard, the receiving device comprising an upright wall surface in the z-direction, an engaging surface extending in the x-direction and the y-direction for transferring a weight force of the user standing on the standing surface extension to a support surface of the fastening device, and an inclined surface of the standing surface extension abutting an inclined surface of the fastening device; wherein the inclined surface of the standing surface extension is inclined relative to the z-direction and the y-direction to prevent the standing surface extension from moving upward in the z-direction relative to the standing surface.

8. The standing surface extension of claim 7, further comprising a locking element for locking the standing surface extension to the skateboard in the x-direction.

9. The standing surface extension of claim 7, wherein the receiving device comprises a form-fitting connection, the form-fitting connection comprising at least one surface for fixing the standing surface extension to the standing surface of the skateboard in at least the y-direction or the z-direction.

10. The standing surface extension of claim 7, wherein the standing surface extension is movable in the x-direction relative to the deck.

11. A skateboard system comprising:

a skateboard comprising a deck defining in part a standing surface of the skateboard for a user and having a front end and a rear end, the deck defining an x-direction and a y-direction, a z-direction being substantially perpendicular to the x-direction and the y-direction;

a first axle disposed proximal to the front end;

a second axle disposed proximal to the rear end;

a standing surface extension for interchangeably extending the standing surface at the front end or the rear end;

wherein the deck comprises a first fastening device at the front end and a substantially identical second fastening device at the rear end, each fastening device for attaching the standing surface extension to the front end or the rear end;

wherein each fastening device comprises a first upright wall surface in the z-direction, a support surface extending in the x-direction and the y-direction for supporting a weight force of the user standing on the standing surface extension, and a first inclined surface extending from an edge of the support surface;

wherein the standing surface extension comprises a second upright wall surface in the z-direction, an engaging surface extending in the x-direction and the y-direction for transferring a weight force of the user standing on the standing surface extension to the support surface, and a second inclined surface abutting the first inclined surface, the second inclined surface preventing the standing surface extension from moving upward in the z-direction relative to the deck.

12. The system of claim 11, further comprising a locking element for locking the standing surface extension to the skateboard in x-direction.

13. The system of claim 12, further comprising a form-fitting connection or force-fitting connection;

wherein the locking element locks the standing surface extension and the skateboard using the form-fitting connection or force-fitting connection.

14. The system of claim 12, further comprising a form-fitting connection or force-fitting connection;

wherein the locking element is releasably held in a locked position by clamping, by the form-fitting connection, or by pretension at the locking position.

15. A skateboard system comprising:

a skateboard comprising a deck defining in part a standing surface of the skateboard for a user and having a front end and a rear end, the deck defining an x-direction and a y-direction, a z-direction being substantially perpendicular to the x-direction and the y-direction;

a first axle disposed proximal to the front end;

a second axle disposed proximal to the rear end;

a first standing surface extension for extending the standing surface at the front end and a second standing surface extending the standing surface at the rear end;

wherein the deck comprises a first fastening device at the front end and a substantially identical second fastening device at the rear end, each fastening device for attaching a respective standing surface extension to the respective front end or the rear end;

wherein each fastening device comprises a first inclined surface extending from an edge of the support surface;

wherein each standing surface extension comprises a second inclined surface abutting the first inclined surface;

wherein the second inclined surface is inclined relative to the z-direction and the y-direction preventing the standing surface extension from moving upward in the z-direction relative to the deck.

16. The system of claim 15, further comprising a locking element for locking the standing surface extension to the skateboard in x-direction.

17. The system of claim 15, wherein each fastening device further comprises a first upright wall surface in the z-direction, and a support surface extending in the x-direction and the y-direction for supporting a weight force of the user standing on the standing surface extension.

18. The system of claim 17, wherein each standing surface extension further comprises a second upright wall surface in the z-direction, an engaging surface extending in the x-direction and the y-direction for transferring a weight force of the user standing on the standing surface extension to the support surface.

* * * * *